United States Patent [19]

Holmes et al.

[11] 4,428,730

[45] Jan. 31, 1984

[54] INSULATION FOR A FURNACE MEMBER

[75] Inventors: Clyde A. Holmes, Turtle Creek Borough; Macy W. Vance, Export Borough, both of Pa.

[73] Assignee: United States Steel Corporation, Pittsburgh, Pa.

[21] Appl. No.: 401,458

[22] Filed: Jul. 26, 1982

Related U.S. Application Data

[63] Continuation-in-part of Ser. No. 266,686, May 20, 1981, abandoned.

[51] Int. Cl.[3] ..... F27D 1/16; F27D 3/02; D03D 49/26

[52] U.S. Cl. ..... 432/3; 138/149; 432/234

[58] Field of Search ..... 432/3, 234; 138/149

[56] References Cited

U.S. PATENT DOCUMENTS

| | | | |
|---|---|---|---|
| 3,058,860 | 10/1962 | Rutter | 138/147 |
| 3,781,167 | 12/1973 | Ahonen | 432/234 |
| 4,095,937 | 6/1978 | Colburn et al. | 432/3 |

FOREIGN PATENT DOCUMENTS

| | | | |
|---|---|---|---|
| 2435001 | 2/1975 | Fed. Rep. of Germany | 432/234 |

*Primary Examiner*—John J. Camby

*Attorney, Agent, or Firm*—William F. Riesmeyer, III

[57] ABSTRACT

An improved insulation is provided for furnace members, particularly verticals, cross supports and skid pipes in slab reheating furnaces. The insulation includes a metal spring-clip having outward projections on which refractory tiles are formed. An intermediate layer is provided between the outer surface of the clip and the tiles so as to reduce friction and prevent cohesion between the clip and tiles. Thus, when the clip is spread for installation on the pipes, the tiles will not break.

10 Claims, 6 Drawing Figures

INSULATION FOR A FURNACE MEMBER

BACKGROUND OF THE INVENTION

This application is a continuation-in-part of our prior co-pending application Ser. No. 266,686 filed May 20, 1981, now abandoned.

This invention relates to an insulation for furnace members, particularly to the type utilizing a spring-clip for attachment to the member.

In general, there are two types of insulation commonly used on pipes in slab furnaces. In one, an imbedded metal clip or wire mesh is welded to the pipe. Though resistant to vibration, this type is time-consuming and costly to install. The other type is simply hung on lugs secured to the pipe. Of course the lugs must be accurately positioned so that not much time is saved in installation.

In U.S. Pat. No. 4,140,483 Errington, a spring-clip having outward radial projections is attached to the pipe. Subsequently, refractory tiles having holes for the projections are hung on the clip. The holes are then closed with air-set cement. The service life of this insulation is diminished by cracking of the cement, especially where substantial vibration is present, ultimately causing the tiles to fall off.

The primary object of the instant invention is to provide a spring-clip type of insulation which is easy to install and has longer service life than any presently available.

SUMMARY OF THE INVENTION

According to this invention an improved insulation is provided for internally cooled furnace members. The product includes a generally c-shaped metal spring-clip substantially all of the inner surface of which is designed for making intimate contact with the exterior surface of the furnace member. This assures proper cooling of the clip itself and retention of its spring-like properties. The clip has inwardly protruding end portions partially closing its interior opening. The spacing between these end portions is intentionally made significantly less than the cross sectional dimension of the furnace member at the location to be abutted by the clip. This assures proper spring action after the clip is spread open for insertion transversely over, and onto the periphery, of the member. The springiness of the clip itself and the spacing just mentioned are correlated so as to permit both (1) spreading of the clip for insertion, and (2) retention of it at elevated furnace temperatures by continued spring action.

The clip has a plurality of spaced outwardly extending projections, and at least two circumferentially segmented refractory tiles formed on its outer surface covering the projections. By forming we refer to either conventional casting or pressing techniques. It is important that the tiles be so formed as to completely cover the surface of the projections and thus be joined thereby to the clip so as to withstand furnace vibration. The tiles are spaced apart at adjacent ends remote from the C-opening, sufficiently to prevent their abutment when the clip is spread for insertion. An essential feature of the invention is that, prior to formation of the tiles on the clip, an intermediate layer is applied to the outer clip surface. The layer may be a lubricant coating or pad of ceramic fiber material. After forming of the refractory and then curing to dry it, the intermediate layer prevents bonding of the tiles to the clip. The lubricant may be organic, for example, a petroleum base material such as automotive grease. Or the lubricant may be graphite, silicone or other inorganic material. The only requirement is that the coating reduce friction between the clip and tiles and prevent cohesion between them. In the case of ceramic fiber, a number of insulating fibers are available commercially. The fiber pad may be cemented to the clip for convenience during manufacture. The cement in this case does not act as a lubricant. Lubrication is unnecessary when the pad is used as an intermediate layer. Also, in preferred form an insert is provided where is is desired to cover the entire periphery of the furnace member. The insert includes a metal clip, also having spaced outward projections, and a refractory tile formed thereon. Since the insert is not required to flex for insertion, no intermediate layer is required.

The invention also provides a unique method for making insulation for furnace members. It includes forming a generally C-shaped metal spring-clip with spaced projections extending outwardly from it. Preferably, the clip is of heat-treatable steel composition and the method includes heat treatment of the clip to Rockwell C 45/55 aim 50 after forming. For example, type 410 stainless steel has been used. More recently, an alloy steel known as Jethete M-152 made by Universal Cyclops Corporation has been used. This latter steel has good strength at temperatures up to 700° C. which is preferable in applications where the invention is used in high temperature furnaces, such as steel reheat furnaces. An intermediate layer is provided on the outer clip surface prior to formation of refractory tiles. The tiles are formed by either casting or pressing, in either case making intimate contact with and covering the clip projections. After this the tiles are cured by conventional methods to dry them. Thus, a method is provided for making a spring-clip type insulation which can be installed as a unit on the furnace member.

DESCRIPTION OF THE PREFERRED EMBODIMENT

Figure 1:
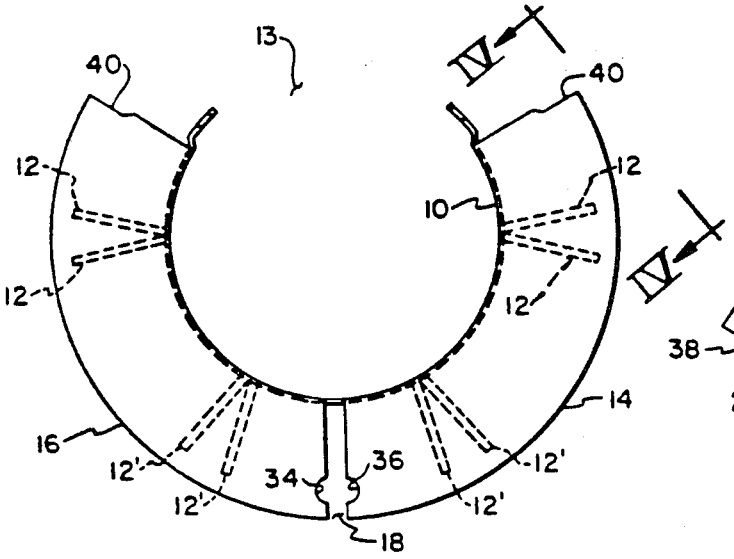
FIG. 1 is a side elevation view of the insulation of the present invention.
Figure 3:
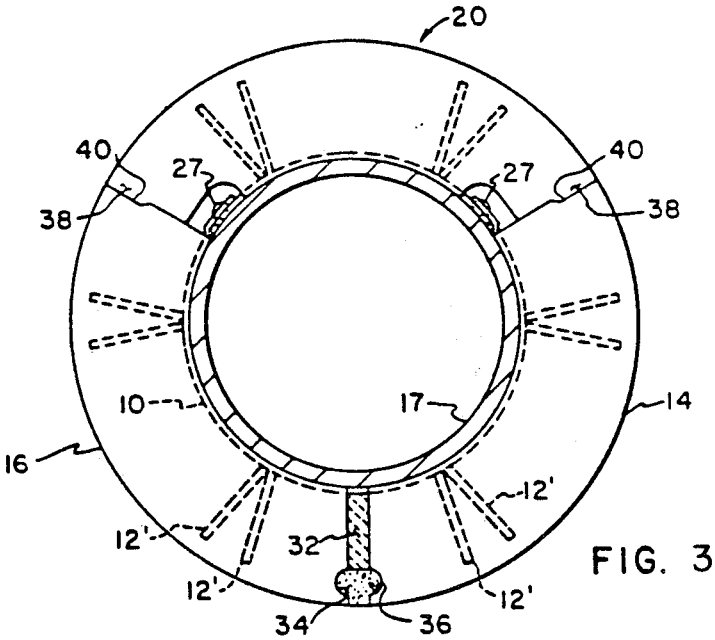
FIG. 3 is a side elevation view of the insulations of FIGS. 1 and 2 shown as combined on a furnace member.

Referring to FIGS. 1 and 3, the product of this invention includes spring-clip 10 having projections 12 and 12' on which refractory tiles 14, 16 are formed. It is essential that the clip have sufficient springiness to remain attached to member 17 (shown in FIG. 3) at service temperature in the furnace. Where used on water-cooled verticals, cross supports and skid pipes in steel slab reheating furnaces, it is important that substantially all of the inner surface of clip 10 maintain contact with the pipe so that the clip will remain cool and not lose spring action. Desirably, a heat treatable steel composition is used for the clip material so that it may be formed readily then austenitized, quenched and tempered to achieve desired springiness. SAE 1050 steel, type 410 stainless steel and Jethete M-152 are examples of compositions which may be used. We have found that a hardness aim of Rockwell C50 after heat treatment provides sufficient springiness. It will be apparent that the clip must cover at least slightly more than 180° of a circular pipe in order to remain attached by spring action. Preferably, about 255° to 270° of the circumference is covered.

Projections 12 serve to lock the tiles so that they will remain attached to the clip. It is desirable that they be of stainless steel (AISI Type 304 or 310 for example) so as to resist oxidation by the furnace atmosphere. A V-shape is preferred for best locking action. To prevent breakage of the tiles upon installation, the prongs of V-projections 12' remote from clip opening 13 preferably lie in the plane plane normal to the axis of the pipe 17 (see FIG. 1 or 3). Thus, if the product is installed by using a board applied to the lower end of the tiles for pushing them onto the pipe this configuration withstands the forces applied.

The tiles may be of any refractory composition suitable for the temperatures to which they will be exposed in the furnaces. However, the invention is limited to tiles which are formed by casting or pressing of particulates, into a mold so as to be formed directly onto and covering the projections. Refractory of sufficient thermal resistance must be used to protect the clip. For some applications a relatively lightweight refractory may be required even though these are generally more expensive. For example, the refractory may have a density of less than 80 lbs./cu.ft. In such cases a lubricant coating is sufficient to serve as the intermediate layer. However, the denser refractory materials are cheaper and may be more desirable in some applications. The increased weight causes additional problems. Generally, a ceramic fiber is used as the intermediate layer in such cases, to increase the insulation value of the product and offer increased protection for the clip. Adequate spacing 18 must be provided between the tiles at their adjacent lower ends as shown to permit spreading of the clip for insertion without abutment and breakage of the tile sections. An essential feature of the present invention is to provide an intermediate layer on the outer surface of the clip prior to forming the tiles. In one embodiment shown in FIG. 1, a lubricant coating such as automotive grease is applied to the outer surface of clip 10. This prevents adhesion and reduces the coefficient of friction between the tile and the clip. Thus, when the clip is spread for insertion onto the pipe, it may flex without breaking the tiles. The tiles remain joined to the clip since they are formed directly onto and locked in place by projections 12. Although any organic lubricant or other conventional mold parting compound may be used, we prefer a petroleum base material such as automotive grease.

Figure 2:
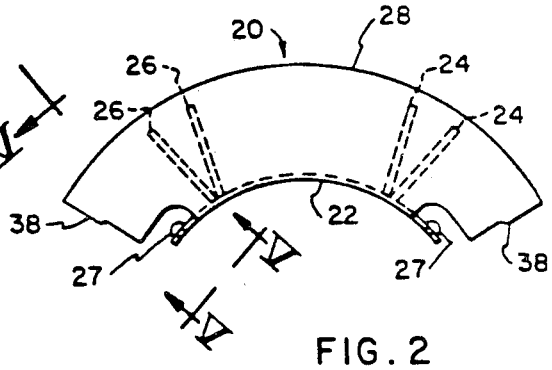
FIG. 2 is a side elevation of an insert for completing coverage of the periphery of a furnace member to which the insulation of FIG. 1 is attached.
Figure 5:
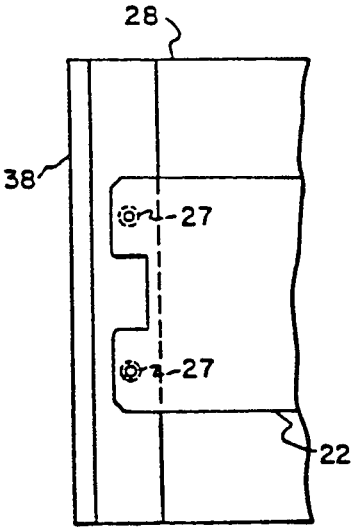
FIG. 5 is a view taken at V—V of FIG. 2.
Figure 4:
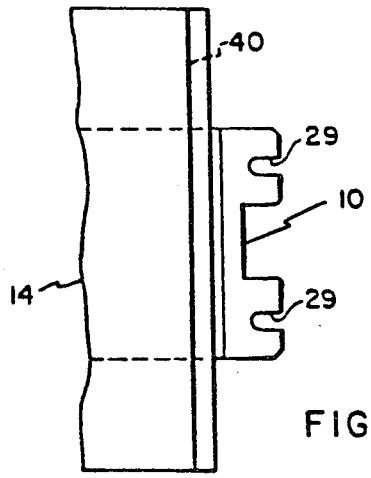
FIG. 4 is a view taken at IV—IV of FIG. 1.

To complete insulation of the entire circumference of vertical or cross supports, an insert 20 is provided as shown in FIGS. 2 and 3. A metal clip 22 is provided of circular segmental shape and has spaced projections 24, 26. Refractory tile 28' is formed covering the projections so as to be joined to the tile. It will be quite apparent that insert clip 22 need not have the springiness which is essential for clip 10. Clip 22 does have a dimple or button-like projection 27, (FIGS. 2 and 5) protruding from its opposite ends for engaging mateable slots 29, (FIG. 4) in adjoining ends of spring-clip 10. The total assembly is shown in FIG. 3 mounted on pipe 17. Ceramic fiber blanket 32 is used to partially fill the space between tiles 14 and 16, and air-set mortar 36 is used to fully close the joint and remains locked in place by grooves 34 adjacent to the outer tile surfaces. Mateable step-joints 38, 40 which are sealed with refractory cement are provided on adjacent edges of tiles 14, 16 and insert tile 28. These mortared steps are essential for providing protection of the exposed portions of the clips from the furnace atmosphere and temperature. When the insulation is used on skid pipes, thus not permitting use of an insert for complete covering of the pipe, the exposed parts of the spring-clip are covered by air set refractory cement.

Figure 6:
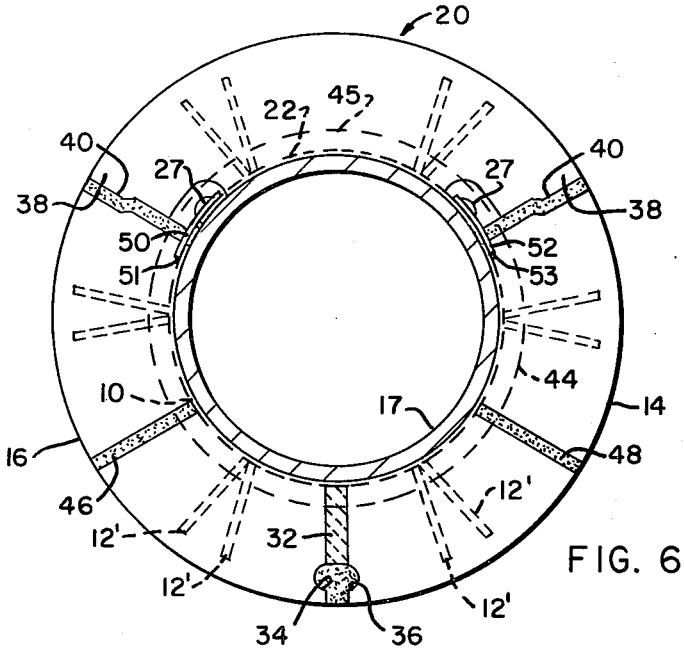
FIG. 6 is a side elevation view of another embodiment of the invention.

Referring to FIG. 6 a more preferred embodiment is shown in which a dense (greater than 80 lbs./cu.ft.) refractory is used for the tile material. To provide more insulation and protect the clip from heat, a pad 44 of lightweight ceramic fiber material having a density of 15 to 25 lbs./cu.ft. is used forming an intermediate layer between clip 10 and tiles 14, 16. In this embodiment no lubricant is used, although it may be applied to the projections 12 if desired. Also, pad 44 may be cemented to clip 10 for convenience during manufacture. Slots 46, 48 are sawcut or cast in the tiles to provide for strain relief in the refractory during installation. These slots may be used in tiles using both lightweight and dense refractory. The slots help prevent the tiles from cracking when the clip is spread for insertion on the furnace pipe. The slots and groove 32 are filled with fiber and refractory cement as previously described. In this embodiment the ends 50, 52 of clip 10 are formed by welding additional pieces of the same clip material onto the clip. This helps to prevent bending of the clip ends when the clip is spread. Clip ends 50, 52 have holes for receipt of button-like projections of the insert clip 22 as in the prior embodiment. Again, no intermediate layer is required between the insert clip and insert tile 28.

The insulation is made first by rolling or forming a band to a shape and of dimensions closely conforming to that of the member on which it is to be mounted. Then, either as a separate step or part of the initial forming operation, the opposed ends of the clip are crimped to an intentionally and significantly smaller spacing than the cross sectional distance of the location to be abutted by those ends on the pipe or member on which the clip is to be mounted. This distance will depend on the springiness of the clip itself and other factors, e.g., pipe diameter, etc. For a 5½ inch pipe covered 270° of its circumference we crimp from a normal spaoing of 4½ inches to anywhere from 3½–3⅝ inches. We form the projections, desirably by welding Type 304 stainless rod to the clip surface in V-shapes. Then, the clip is heat treated by austenitizing at about 1650° F., water or oil quenching as indicated and then tempering between 400°–1000° F. to attain a Rockwell C hardness of 50. As previously mentioned, an essential feature involves providing an intermediate layer on the outer surface 42 of clip 10. A mold is then placed around the clip and refractory material cast or pressed in place covering the projections. Finally, the refractory is cured by drying in conventional fashion forming an insulation which can be easily mounted on furnace members.

Various alternative configurations may be contemplated. For example the invention would seemingly work quite well on support members of other than circular shape for example triangular, trapezoidal, or rectangular with side indentations. The only requirements would be that the member have sufficient indentation in its cross section to permit gripping action of a spring-clip thereon, and that the member have corners of sufficiently large curvature that the clip can tightly engage those areas to remain cooled by the member itself where it is used in high temperature environments. Similarly, many different materials might be used for the spring-clip provided it has sufficient springiness to remain in position under the service conditions of the particular application. The furnace temperature, atmosphere and degree of vibration may be important factors in selection of the material. Also, projections other than V-shape would presumably work. These and other embodiments are within the scope of the invention covered by the appended claims.

We claim:

1. An exterior insulation for an internally cooled elongated furnace member, said insulation comprising:

a generally C-shaped metal spring-clip for making intimate contact along substantially all of the inner surface thereof with said member so as to be cooled thereby, said spring-clip having inwardly protruding opposed end portions partially closing the opening therein and a plurality of spaced projections extending outwardly therefrom, the spacing between said end portions prior to insertion on said member being significantly less than the cross sectional dimension of said member at the location to be abutted by said portions, the springiness of said clip and spacing between said end portions being sufficient for both, (1) spreading and insertion of said clip transversely onto said member, and (2) retention thereof at elevated temperature by spring action, and at least two circumferentially divided refractory tile segments formed on said spring-clip prior to insertion on said member and joined to said clip by said projections, said refractory having sufficient insulating property to protect said clip from the furnace temperatures, said segments having been formed by, first applying to the outer surface of said clip, an intermediate layer selected from the group consisting of organic lubricant, inorganic lubricant, and refractory fiber material, said layer serving to prevent adhesion of the tiles to said clip and prevent breakage of the tiles when said clip is spread for insertion.

2. The insulation of claim 1 wherein said intermediate layer is a lubricant.

3. The insulation of claim 1 wherein said intermediate layer is a ceramic fiber pad.

4. The insulation of claim 1 wherein said projections include legs forming a V-shape.

5. The insulation of claim 1 further comprising an insert for covering a remaining portion of the circumference of said member, said insert including a metal clip shaped to fit the remaining periphery of said member not covered by said C-shaped metal spring-clip, spaced projections extending outwardly from said insert clip, and a third refractory tile formed thereon, the adjacent ends of said insert clip and spring-clip being adapted for inter-engagement to secure the insert in position on said member.

6. A method of making exterior insulation for an internally cooled elongated furnace member, said method comprising:

forming a generally C-shaped metal spring-clip for making intimate contact along substantially all of the inner surface thereof with said member so as to be cooled thereby and remain installed thereon by spring action, providing a plurality of spaced projections extending outwardly from said spring-clip, applying an intermediate layer to the outer surface of said spring-clip, said intermediate layer being selected from the group consisting of organic lubricant, inorganic lubricant and refractory fiber material, and then forming circumferentially segmented refractory tiles on said clip covering said projections and curing said refractory, said intermediate layer serving to reduce friction and prevent cohesion of said tiles to the clip.

7. The method of claim 6 wherein said metal spring-clip is a heat-treatable steel composition and said method further comprises heat treating said spring-clip, prior to applying lubricant thereon, to a hardness of 45/55 aim 50 Rockwell C.

8. The method of claim 6 wherein said intermediate layer is a lubricant coating.

9. The method of claim 6 wherein said intermediate layer is a ceramic fiber pad.

10. The method of claim 6 wherein said forming of the spring-clip includes crimping opposed end portions of said clip to provide spacing therebetween significantly less than the cross sectional dimension of said member at a location to be abutted by said portions after installation.

* * * * *